United States Patent [19]

Kirby

[11] 4,208,083

[45] Jun. 17, 1980

[54] SOLDERLESS ELECTRICAL CONNECTOR

[75] Inventor: Edward Kirby, Elk Grove Village, Ill.

[73] Assignee: TRW Inc., Cleveland, Ohio

[21] Appl. No.: 934,076

[22] Filed: Aug. 16, 1978

Related U.S. Application Data

[63] Continuation of Ser. No. 774,462, Mar. 4, 1977, abandoned.

[51] Int. Cl.[2] ..... H01R 13/38

[52] U.S. Cl. ..... 339/97 P

[58] Field of Search ..... 339/97 R, 97 P, 98, 339/99 R, 223 R, 176 M

[56] References Cited

U.S. PATENT DOCUMENTS

| | | | |
|---|---|---|---|
| 3,605,071 | 9/1971 | Sedlacek | 339/97 P |
| 3,824,527 | 7/1974 | Evans | 339/97 R |
| 3,860,318 | 1/1975 | Reavis, Jr. et al. | 339/99 R |
| 3,867,005 | 2/1975 | Hoppe, Jr. | 339/223 R |
| 3,902,154 | 8/1975 | McKee | 339/233 R |

FOREIGN PATENT DOCUMENTS

| | | | |
|---|---|---|---|
| 2541064 | 3/1977 | Fed. Rep. of Germany | 339/98 |
| 2643112 | 3/1978 | Fed. Rep. of Germany | 339/97 P |

*Primary Examiner*—Joseph H. McGlynn

*Attorney, Agent, or Firm*—Neuman, Williams, Anderson & Olson

[57] ABSTRACT

A solderless electrical connector is provided for use in interconnecting a plurality of insulated electrical conductors, i.e., each having an insulation covering or cover. The connector includes a housing of dielectric material having a plurality of spaced pockets, each pocket having an entry opposite a base thereof. Disposed within each pocket is an electrical contact element which has a mating portion and a plurality of termination portions. Each termination portion is provided with jaw means which form a pair of narrow passages into which a segment of a conductor is positioned. When the conductor segment is positioned within the narrow passages the insulation cover is ruptured by the jaw means and electrical contact is made. Each termination portion is also provided with conductor-restraining means which is disposed adjacent the jaw means. The restraining means frictionally engages a portion of the insulation covering adjacent the conductor segment and retains the latter within the narrow passages of the termination portion.

2 Claims, 11 Drawing Figures

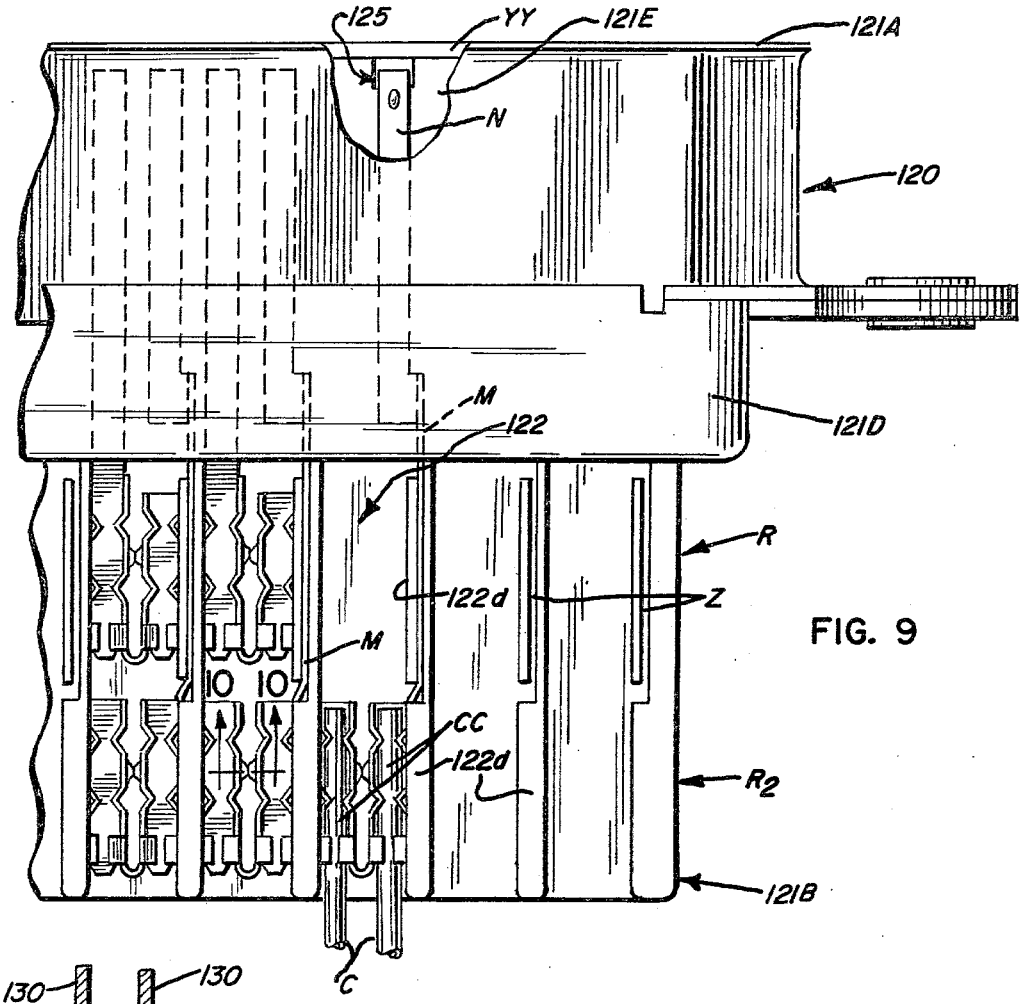
FIG. 9
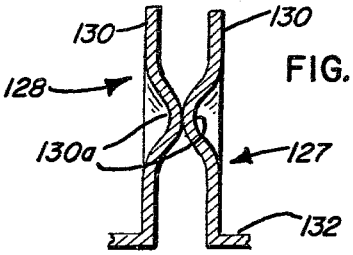
FIG. 10
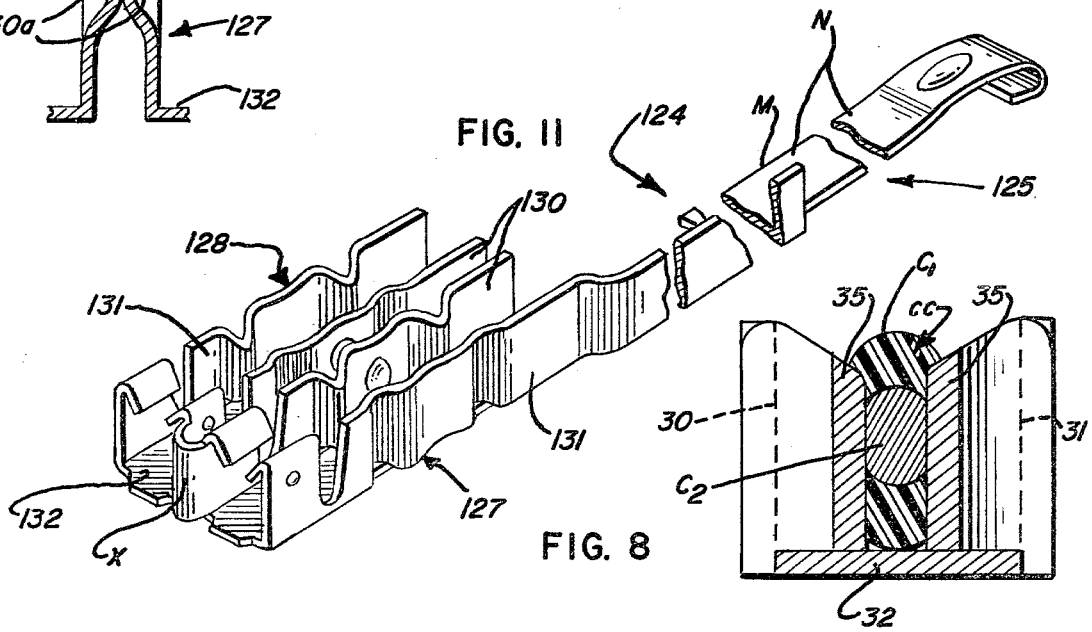
FIG. 11
FIG. 8

SOLDERLESS ELECTRICAL CONNECTOR

This is a continuation of application Ser. No. 774,462 filed Mar. 4, 1977, now abandoned.

BACKGROUND OF THE INVENTION

The use of multi-wire termination systems in various electronic and telecommunication installations is extensive because such systems are easy to install, are compact, are substantially maintenance-free, and are easy to connect and disconnect, when required. Various systems of this general type have heretofore been provided, e.g., as shown in U.S. Pat. No. 3,902,154.

SUMMARY OF THE INVENTION

It is an object of the invention to provide an improved solderless electrical connector which increases substantially the number of electrical conductors that can be accommodated within a connector having a given number of contact elements.

It is a further object of the invention to provide an improved solderless electrical connector which enables a large number of electrical conductors to be readily handled simultaneously when making or breaking electrical contact with other conductors.

It is a further object of the invention to provide an improved solderless electrical connector which facilitates the positioning of a multitude of conductors on a given connector.

It is a further object of the invention to provide an improved solderless connector which is not susceptible to malfunction.

It is a further object of the invention to provide an improved solderless electrical connector wherein each of a plurality of conductors has a segment thereof disposed within a separate passage in the same contact element whereby the insulation cover of the conductor or wire segment is ruptured and an electrical contact is made with the segment; furthermore, the contact element of the connector frictionally retains the wire segment in position within the narrow passages for strain relief.

Further and additional objects will appear from the description, accompanying drawings and appended claims.

In accordance with one embodiment of the invention, an improved solderless electrical connector is provided for accommodating a plurality of electrical conductors, each of the latter having an insulation cover. The connector is provided with a housing of dielectric material having formed therein a plurality of spaced pockets, each pocket including a base and an entry opposite thereto through which a plurality of conductors simultaneously extend. Disposed within each pocket is an electrical contact element which has a mating portion and a plurality of conductor-receiving termination portions. Each termination portion is provided with a wire-restraining means and contact jaw means adjacent thereto. The jaw means include a pair of relatively spaced narrow passages opening to the pocket entry. Each of the pair of narrow passages is adapted to receive a segment of a conductor. The jaw means effect rupturing of the insulation cover and make electrical contact with the core of the wire segment. The restraining means frictionally engages the insulation cover of the wire adjacent the contact jaws and retains the wire in position within the narrow passages.

DESCRIPTION

For a more complete understanding of the invention reference should be made to the drawings wherein:

FIG. 8 is an enlarged vertical sectional view taken along line 8—8 of FIG. 7 and showing a conductor segment in electrical contact with a termination portion of a contact element.

FIG. 9 is similar to FIG. 2 but of a modified form of the improved solderless electrical connector shown with a pair of conductor segments accommodated by one of the contact elements thereof.

FIG. 10 is an enlarged fragmentary sectional view taken along line 10—10 of FIG. 9.

FIG. 11 is an enlarged fragmentary perspective view of one of the contact elements embodied in the connector of FIG. 9.

Figure 1:
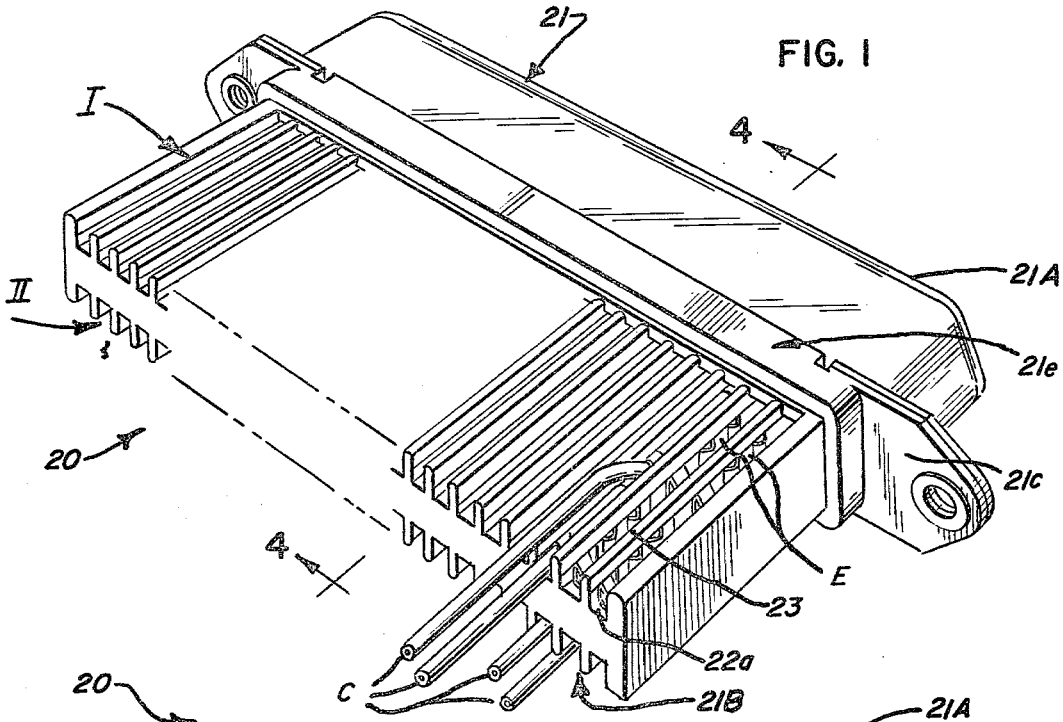
FIG. 1 is a fragmentary perspective view of one form of the improved solderless electrical connector and showing only two pairs of electrical conductors assembled therewith.

Referring now to the drawings and more particularly to FIGS. 1–4, a preferred embodiment of an improved connector 20 is shown which is adapted to facilitate the connection of a number of insulated conductors (wires) C extending generally in the same direction from a multi-conductor cable or the like, not shown, normally incorporated in a telecommunication system. The connector 20, as illustrated, corresponds in overall construction and intermateability to the connector shown in the aforementioned U.S. Pat. No. 3,902,154. The connector 20 is adapted to electrically and mechanically mate with a complementary unit, not shown, which is embodied in the system.

It will be appreciated that the multi-termination arrangement of this invention similarly is applicable to contacts in connectors of other types, e.g., so called paddle board connectors. Moreover, such contacts may utilize mating portions of other configurations suitable for establishing electrical connection to other conductive elements by a variety of techniques.

The connector 20 in the illustrated embodiment includes a housing 21 preferably molded of a suitable dielectric material. The housing 21 is provided with a cavitated first side section 21A, which is adapted to electrically and mechanically mate with the complementary unit, and a second side section 21B which is adapted to accommodate a plurality of conductors in a manner to be hereinafter described. A mounting flange 21C is provided on the housing which projects laterally outwardly from a central section 21D disposed intermediate side sections 21A and B. The flange facilitates fixedly securing the connector to a panel or supporting base, not shown.

Figure 2:
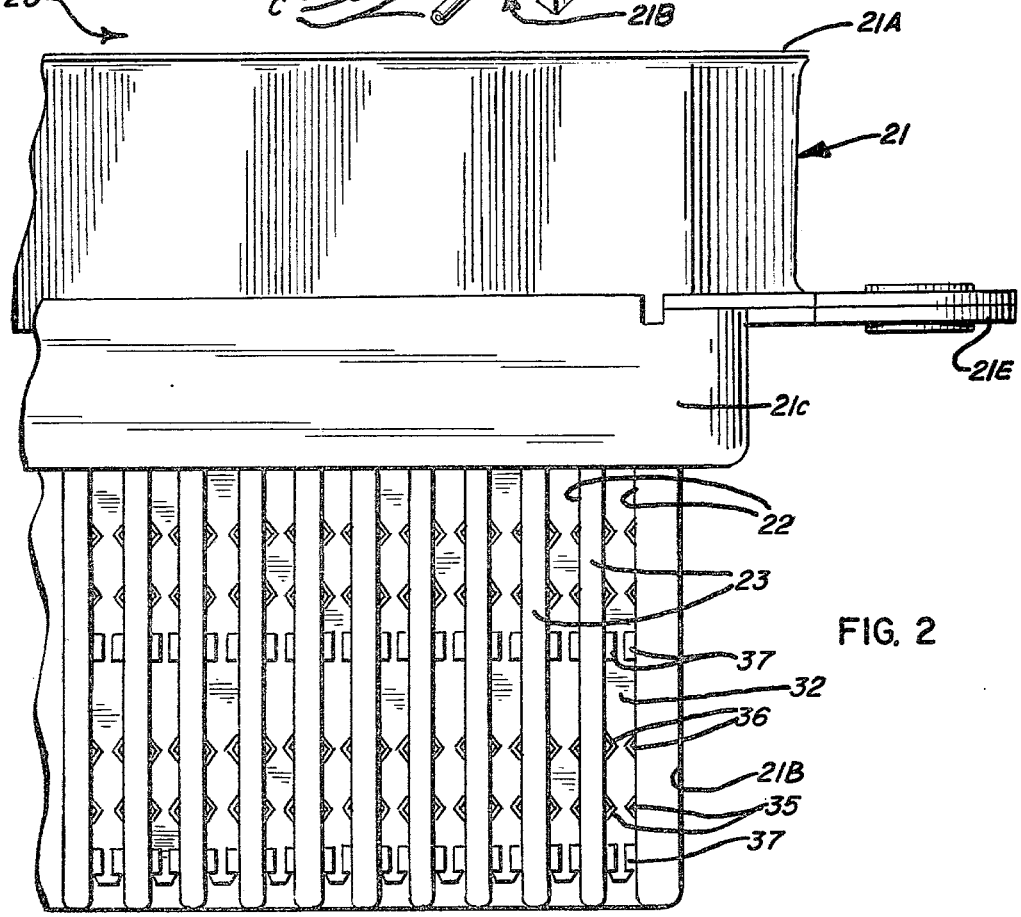
FIG. 2 is an enlarged fragmentary, top plan view of the connector of FIG. 1 and showing no conductors connected thereto.

Side section 21B, as seen in FIGS. 1 and 2, embodies two sets I and II of elongated pockets 22. The pockets, comprising each set, are arranged in side-by-side, substantially parallel relation. Adjacent pockets of a set are separated from one another by an elongated insulating partition or wall 23. Corresponding pockets of the sets are arranged in aligned relation; however, the improved connector is not intended to be limited to such a pocket arrangement. Each pocket 22 in the illustrated connector 20 is elongated and of like configuration and is provided with an elongated entry E which is disposed opposite a base surface 22*a*. A distal outer end 22*b* of pocket 22 is also open, see FIGS. 3 and 4. The opposite end 22*c* of the pocket communicates with a cavity Y formed in the first side section 21A of the housing 21. The cavity Y is adapted to accommodate the mating portion of the complementary unit, not shown.

Figure 5:
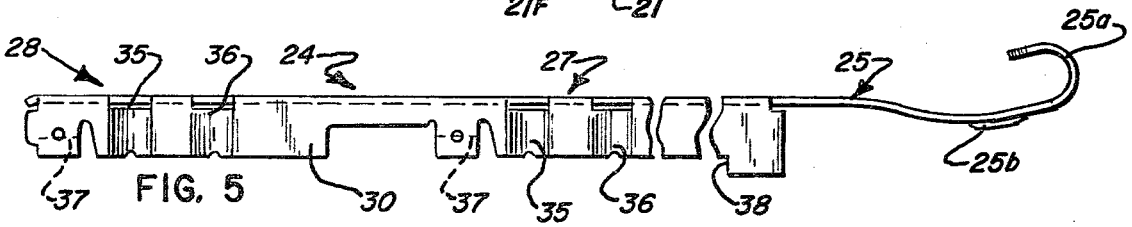
FIG. 5 is an enlarged side elevational view of one of the contact elements per se shown in FIG. 4.
Figure 6:
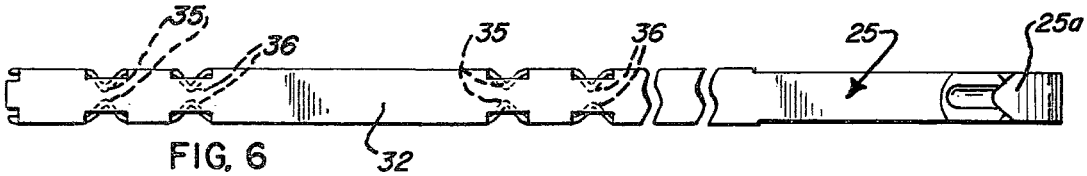
FIG. 6 is an enlarged top view of the contact element as shown in FIG. 5.
Figure 7:
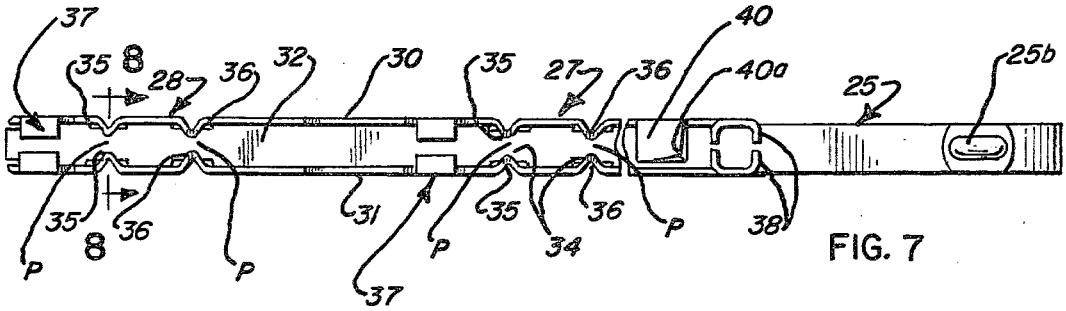
FIG. 7 is an enlarged bottom view of the contact element as shown in FIG. 5.

Each pocket 22 has fixedly positioned therein an elongated contact element 24 which is preferably formed from a blank of suitable metallic sheet material, e.g., 0.006 to 0.010 inch thick cadmium bronze or like suitable material, sheet gold or otherwise plated at contact points so as to avoid corrosion. The contact element 24, as illustrated in FIGS. 5–7, includes a mating portion 25 for establishing electrical continuity with another conductive element. In the contact element 24, the portion 25 is of tongue-like ribbon configuration and extends through the pocket end 22*c* and terminates within cavity Y. The distal end 25*a* of portion 25 is hook-shaped and disposed within a retaining groove 26 formed in the end of a centrally disposed projection 21E formed within the cavity Y.

The contact element 24 also includes two or more termination portions 27 and 28 which in the illustrated embodiment are arranged in tandem or end-to-end relation. Each termination portion 27, 28 is adapted to accommodate and make electrical contact with an end segment CC of a single insulated conductor C in the manner of the terminations in the connector shown in the aforementioned U.S. Pat. No. 3,902,154, see FIGS. 1, 4 and 8. Each termination portion 27, 28 of the contact element 24 is of substantially like configuration and includes a pair of spaced substantially parallel elongated sidewall sections 30, 31. The corresponding elongated edges of the sections 30, 31 are interconnected by a transverse floor section 32. The sidewall sections and the floor section cooperate with one another to define a channel having the open side thereof adjacent the pocket entry E. The spacing between the sidewall sections 30, 31 corresponds substantially to the width of the pocket 22 in which the element 24 is fixedly positioned. The floor section 32 is adapted to engage the base surface 22*a* of the pocket, when the contact element is in place. In the illustrated contact element 24, the floor sections and the corresponding sidewall sections 30, 31 of the termination portions 27, 28 are made integral with one another and the floor section of termination portion 27 is integral with the mating portion 25.

Each termination portion 27, 28 is provided with conductor-restraining means 33 and adjacent jaw means 34. The jaw means in each termination portion includes a pair of laterally spaced protuberances 35, 36 formed in each sidewall section 30, 31. Corresponding protuberances 35, 36 are disposed in closely spaced opposed relation and define therebetween a pair of narrow passages P in which the end segment CC of a single conductor is positioned by pushing the segment into the passages until the floor section 32 is engaged by the insulation cover $C_1$ of the conductor, see FIG. 8. Because of the narrowness of the passage P, the protuberances 35, 36 will cause the insulation cover $C_1$, which encompasses a center strand $C_2$ of the conductor segment, to be ruptured whereby a positive electrical contact is made between the protuberances and the center strand $C_2$. The conductor is of conventional design and may include either a single center strand, as shown, or a cluster of thinner strands arranged in direct contact with one another.

The limit of outward distortion, or splaying, of the sidewall sections 30, 31 and protuberances by the conductor segment is dependent upon the normal spacing of the sidewall sections, when the latter are in a relaxed state, relative to the width of the pocket in which the contact element is located. Notwithstanding some such limited splaying of the sidewall sections, the protuberances are stiff and the shear and compressive strength thereof as compared to that of the insulation cover is such that the cover is ruptured by the protuberances as the wire segment is pushed into the narrow passages and, thus, the conductor is in direct and intimate pressure contact with the protuberances.

In addition to the afore-described jaw means, each termination portion 27, 28 is provided with a strain-relief means 37 (see FIG. 7). The means 37 frictionally engages a portion of the insulation cover $C_1$ adjacent the conductor segment to provide strain relief for the electrical junctions while preventing accidental disassembly of the conductor segment from the narrow passages. The restraining means 37 in the illustrated embodiment of the contact element 24 (see FIGS. 5–7) comprises a pair of opposed tabs 37*a* which are formed on the edges of the sidewall sections 30, 31 and are disposed adjacent the entry E of the pocket 22. The tabs 37*a* converge towards one another in a direction towards the floor section 32. Thus, as the conductor is pushed into the pair of narrow passages P, the portion of the insulation-covered conductor adjacent the contact area frictionally passes between the tabs causing the latter to bend downwardly as required to allow passage without rupturing the insulation. When the wire is fully seated in the termination portion, the insulation cover spreads under the distal or free edge of each tab and is frictionally engaged by the tab and thereby held in place. Because of the thinness of the contact element material, the tabs will bend and frictionally engage the insulation cover rather than cause the same to be ruptured when the conductor segment is being accommodated by the termination portion 27, 28.

As aforementioned, portions 27, 28 of the illustrated contact element 24 are arranged in tandem relation and thus, by reason of this fact, the conductor segment accommodated in termination portion 28, disposed in one of the set I pockets, is overlaid by a portion of conductor in which the end segment thereof is accommodated in the termination portion 27. With regard to a contact element in one of the set II pockets, a portion of the conductor, in which the end segment thereof is accommodated in termination 27, subtends the conductor segment disposed in termination portion 28, see FIG. 4. Thus, when using connector 20 with conductors extending in substantially the same direction towards the housing side section 21B of the connector 20, it is recommended that as to each contact element, the conductor segment be initially positioned within the narrow passages P of termination portion 28 before positioning the second conductor segment in termination portion 27. Thus, in such a situation the positioning of the conductor segments in the termination portions 27, 28 of the contact elements embodied in the connector 20 is a two step operation.

Figure 4:
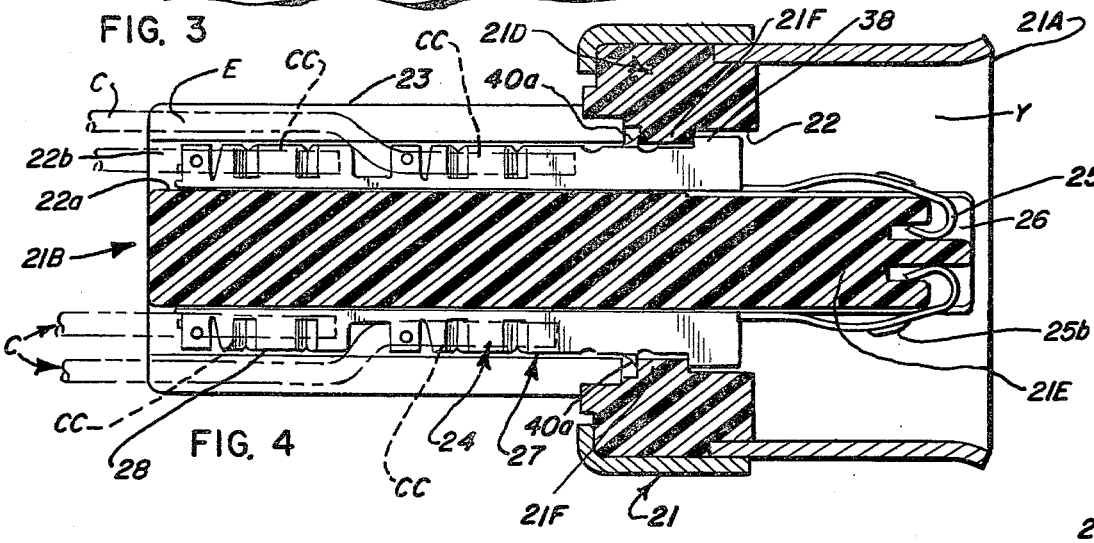
FIG. 4 is an enlarged sectional view taken along line 4—4 of FIG. 1 and showing pairs of conductor segments accommodated within the termination portions of a pair of contact elements.

It will be noted in FIG. 4, that the mating portion 25 of each contact element 24 has a segment thereof which is bowed away from the adjacent surface of the projecting section 21E of the housing. By reason of this arrangement, a more positive electrical contact can be made with a corresponding contact element carried by a mating complementary unit, not shown. In addition to the bowed configuration of portion 25, a dimple **25*b***, gold plated if desired, may be provided to improve the electrical contact with the mating unit.

Figure 3:
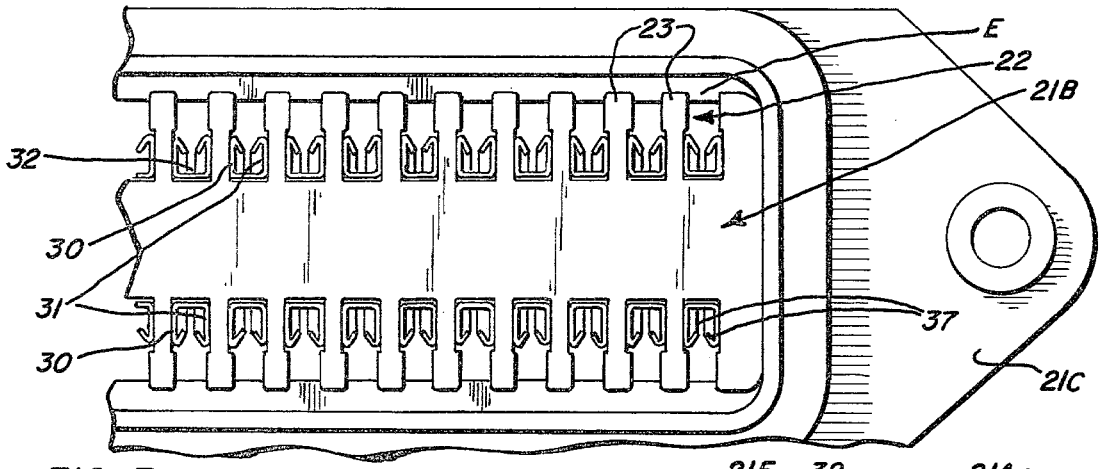
FIG. 3 is a view of the bottom of the connector as seen in FIG. 2.

In assembling a contact element 24 in the respective pocket 22 of the housing 21, the termination portions 27, 28 thereof are inserted into the pocket through the open end **22*c* until stop shoulders 38, formed at one end of sidewall sections 30, 31, abut a step 21F formed in the central section 21D of the housing 21, see FIG. 3**.

To prevent disassembly of the contact element 24 from the pocket 22, the opposite side of step 21F is engaged by a resilient locking tab 40 which is connected to one sidewall section 30, 31. The tab 40 extends towards the opposite sidewall section and has a corner **40*a* thereof offset away from the floor section 32. When the termination portions are being inserted into the pocket through the open end 22*c* thereof and past step 21F, the offset corner is depressed towards floor section 32 allowing the tab 40 to move past the step 21F. Once the offset corner 40*a* has cleared the step, it automatically returns to its normal position and engages the side of the step which is opposite the side thereof engaged by the shoulders 38, see FIG. 4**.

A modified connector 120 is shown in FIGS. 9–11 wherein in place of the termination portions 127 and 128 of each contact element 124 being arranged in tandem relation as in element 24, they are arranged in side-by-side relation, see FIG. 11. Each termination portion 127, 128 is basically the same as termination portions 27, 28, except that in element 124 the portions 127, 128 are interconnected to one another by a bail-like segment X which is integral with sidewall sections 130.

To restrict splaying of the sidewall sections 130, 131 of the termination portions 127, 128 when the conductor segments are being positioned therein, sections 130 are provided with rounded protuberances **130*a* which are in abutting contact with one another, see FIG. 10. The opposing sidewall section 131 of each termination portion is positioned adjacent to a wall 122*d* which forms a partition between adjacent pockets 122 provided in the housing 121, see FIG. 9**.

The housing 121 is provided with sets of pockets 122 disposed on opposite surfaces of the side section 121B, similar to that of housing 21; however, the pockets 122 comprising a set are arranged in two parallel rows $R_1$, $R_2$ with row $R_1$ being disposed closest to the center section 121D of the housing, see FIG. 9. Each pocket 122 of a row has a width and length such that the termination portions 127, 128 of a contact element 124 will be snugly accommodated therein.

As will be noted in FIG. 9, each wall **122*d* of pockets of row $R_1$ is provided with an elongated groove Z which is sized to accommodate a part M of the contact element 124 disposed in one of the pockets of row $R_2$. The mating portion 125 may be offset and axially turned approximately 90° relative to part M and engage the projecting section 121E disposed within the cavity YY formed in the section 121A of the housing in the same manner as in connector 20, see FIG. 9**.

The contact elements disposed within the pockets of row $R_1$ have the mating portions 225 thereof of substantially the same configuration as the mating portions 25 of elements 24, previously described.

Thus, with a connector 120, the conductor segments for a given contact element 124 are disposed in side-by-side relation and are simultaneously positioned within the termination portions 127, 128. Furthermore, it is recommended with connector 120 that the contact elements disposed in the pockets of row $R_2$ be engaged by the conductor segments prior to the contact elements of row $R_1$ being engaged.

With either embodiment of the improved connector it should be noted that no special tools or soldering equipment is required to assemble the conductor segments on the contact elements, and yet a stable positive electrical connection is effected. The improved connector is of compact construction yet notwithstanding this fact it has the capacity of accommodating a large number of conductors.

It is to be noted that the number and the relative disposition of termination portions associated with each contact element in the improved connector may be varied from that shown and described without departing from the scope of the invention. Moreover, as indicated above, this invention is applicable to connectors of various types which may utilize other configurations of the contacts. By having a termination portion for each conductor segment the integrity of the electrical connection between the segment and the contact element is assured. The housing embodied in the improved connector may vary in shape and size over a wide range and will depend upon the location and utilization of the connector in a particular system.

I claim:

1. A solderless electrical connector for electrical conductors having cores of conductive material encompassed by insulation covers, said connector comprising a housing of dielectric material provided with a plurality of spaced pockets, each pocket having a base surface and an entry opposite thereto; and a plurality of electrical contact elements, one being fixedly disposed within each pocket and being adapted to simultaneously accommodate and make electrical contact with the conductors extending through the pocket entry, each contact element being of one piece construction and including a mating portion and a plurality of adjacent conductor-receiving termination portions, a corresponding segment of each portion being interconnected, each termination portion being provided with a separate entry for each conductor, said separate entry being aligned with the pocket entry, each termination portion including elongated sidewall sections arranged in opposed spaced relation and interconnected to one another by a floor section in supporting engagement with the pocket base surface, said sections substantially defining a channel having an open side forming said separate entry, at least one sidewall section of each termination portion being provided with a pair of longitudinally spaced jaw means extending from adjacent said floor section to substantially said separate entry and projecting toward the opposite sidewall section and cooperating therewith to form a pair of relatively spaced narrow passages extending substantially transversely of said channel and from the separate entry to substantially the floor section, said narrow passages opening to said separate entry and into which a segment of a single conductor is adapted to be positioned independently of any other conductor, the jaw means of each termination portion effecting rupturing of the insulation cover and making electrical contact with the core of the segment of a conductor disposed within the narrow passages.

2. The solderless electrical connector of claim 1 wherein each termination portion is provided with a conductor-restraining means, said conductor-restraining means including a pair of opposed projections formed on said sidewall sections adjacent one of said jaw means, said projections extending towards one another and towards said floor section each projection forming an acute angle with the respective sidewall section to which it is connected, said projections being adapted to permit a portion of the conductor to pass therebetween when the conductor segment is being initially positioned within said narrow passages, said projections being adapted to frictionally engage in gripping relation the insulation cover of the conductor portion when the latter is disposed therebetween.

* * * * *